United States Patent [19]

Sebastiani

[11] 3,999,896

[45] Dec. 28, 1976

[54] CONTINUOUSLY OPERATING PISTON PUMP

[76] Inventor: Martin Sebastiani, Owingerstrasse 1, Uberlingen, Germany, 7770

[22] Filed: Sept. 29, 1975

[21] Appl. No.: 617,435

[52] U.S. Cl. ..... 417/383; 417/404

[51] Int. Cl.[2] ..... F04B 9/08; F04B 35/02

[58] Field of Search ..... 417/244, 254, 258, 383, 417/389, 540, 542, 385, 386, 387, 240, 241, 394, 395, 403, 404

[56] References Cited

UNITED STATES PATENTS

| | | | |
|---|---|---|---|
| 592,633 | 10/1897 | Keith | 417/404 |
| 884,131 | 4/1908 | Compton | 417/404 |
| 2,593,316 | 4/1952 | Kraft | 417/540 |
| 3,362,346 | 1/1968 | Bottoms et al. | 417/540 |

FOREIGN PATENTS OR APPLICATIONS

| | | | |
|---|---|---|---|
| 1,166,551 | 10/1969 | United Kingdom | 417/395 |

*Primary Examiner*—Carlton R. Croyle
*Assistant Examiner*—G. P. LaPointe
*Attorney, Agent, or Firm*—W. G. Fasse; W. W. Roberts

[57] ABSTRACT

A continuously operable piston pump for conveying of viscous materials, such as mortar mixes or the like comprises first and second chambers separated from a pressure source, such as a piston cylinder arrangement, by respective flexible wall means. The chambers are connected in series with each other. The pressure source is controlled by a further piston cylinder arrangement including a control valve at each end of the control cylinder. The control valves are operated by a flip-flop means which in turn is actuated by means directly coupling the flip-flop means to the piston rod of the control piston cylinder arrangement. The pressure piston cylinder arrangement and the control piston cylinder arrangement are constructed to have a common axis, and thus also a common piston rod located in said axis. The control valves are connected to said common piston rod.

7 Claims, 3 Drawing Figures

CONTINUOUSLY OPERATING PISTON PUMP

BACKGROUND OF THE INVENTION

The invention relates to a continuously operable piston pump for conveying viscous materials, for example, mortar mixes and the like.

Pumps of this type are generally driven by means of an electric motor or an internal combustion engine through additional gear means. The pump and drive means normally form a structural unit. Such units are, for example, described in German Pat. No. 1,453,644. Drive means of this type have a substantial weight and are rather unwieldy. Thus, these drive means severely limit the handling and use of the pump, especially if the pump is to be used in locations which are hard to reach or on structures of a temporary nature, such as scaffolds and the like.

OBJECTS OF THE INVENTION

In view of the above, it is the aim of the invention to achieve the following objects singly or in combination:

to avoid the drawbacks of the prior art, specifically, to reduce the weight of the pump equipment and to construct it in a compact manner so as to reduce the space requirement;

to construct the pumps of the type here described in such a manner that they may be used on temporary structures, such as scaffolds and the like without requiring a heavy foundation;

to drive and control the pumping cylinder piston arrangement by means of a control piston cylinder arrangement which in turn automatically actuates a flip-flop means for its own reversal;

to operate the control piston cylinder arrangement by means of a pressure medium, for example, pressurized air to thereby avoid the use of an electric motor or an internal combustion engine; and to provide means by which the quantity of the viscous material being conveyed and the conveying velocity may be adjusted.

SUMMARY OF THE INVENTION

According to the invention there is provided a pressure operated piston cylinder pump which comprises two piston cylinder arrangements. One piston cylinder arrangement performs the conveying work and the other piston cylinder arrangement supplies the necessary power to the first mentioned piston cylinder arrangement, whereby flip-flop means responsive to the back and forth movement of a piston rod automatically controls the back and forth reversal of the control piston cylinder arrangement. The pressure medium in the piston cylinder arrangement performing the conveying work may, for example, be a liquid, such as oil. The medium for operating the control piston cylinder arrangement which transmits the power to the work piston is preferably a compressible gas, for example, pressurized air. Especially this feature has the advantage that the total weight of the equipment is substantially reduced, because the planetary gear means heretofore required are altogether obviated and the electric motor or the internal combustion engine has been replaced by a light weight, compact control piston cylinder arrangement driven by pressurized air or any other suitable pressurized gas.

According to the invention, the work performing piston cylinder arrangement and the power transmitting control piston cylinder arrangement are integrated into a compact unit having a common axis and the two pistons are mechanically, rigidly coupled to each other. This feature not only still further reduces the weight of the pump, it also greatly facilitates the manufacture and assembly of the individual parts of the pump.

BRIEF FIGURE DESCRIPTION

In order that the invention may be clearly understood, it will now be described by way of example, with reference to the accompanying drawings, wherein.

DETAILED DESCRIPTION OF EXAMPLE EMBODIMENTS

Figure 1:
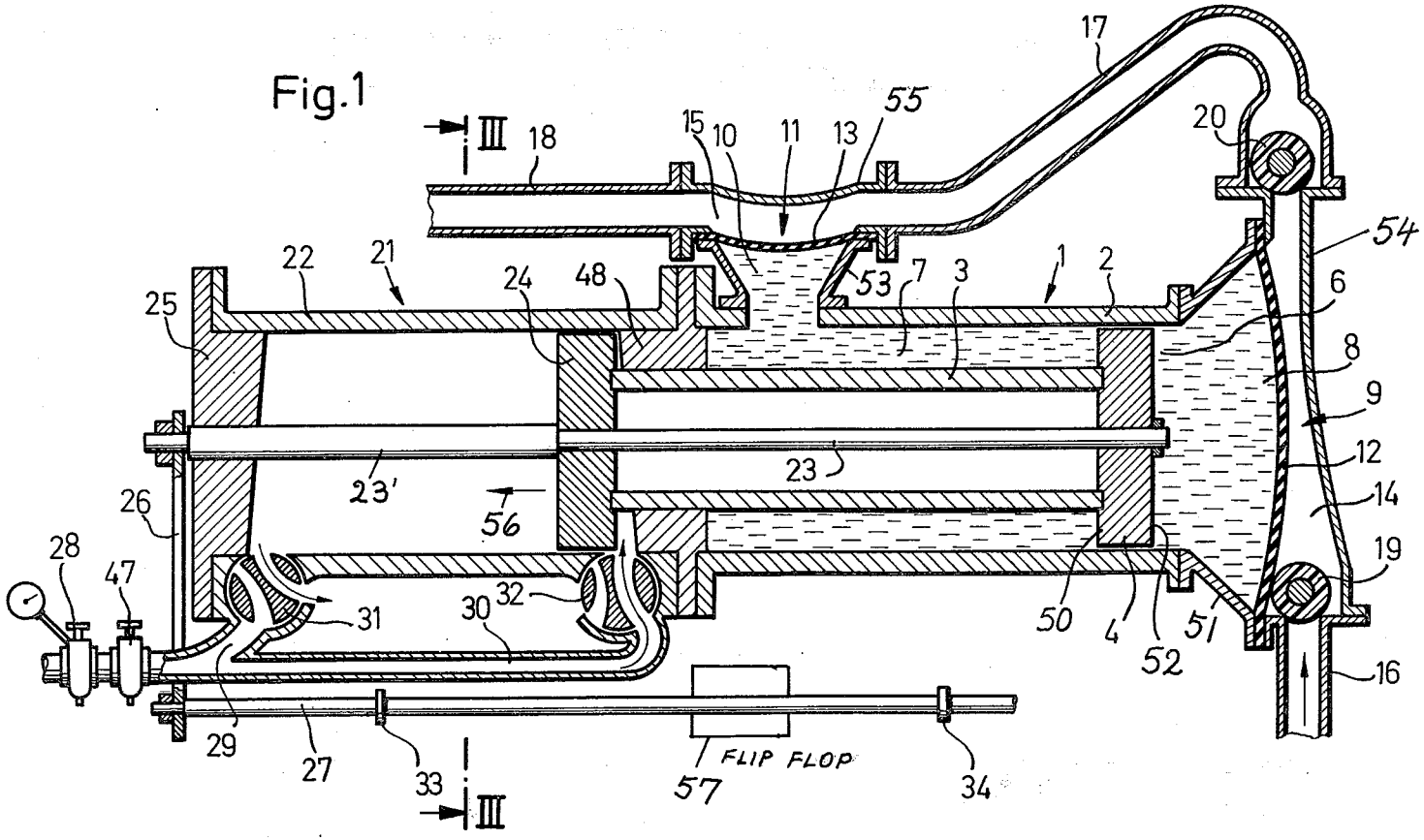
FIG. 1 is a longitudinal, sectional view through a piston pump according to the invention, wherein the reversing control mechanism is shown only schematically.

The piston pump according to the invention comprises a first piston cylinder arrangement 1 and a second piston cylinder arrangement 21 as shown in FIG. 1. The first piston cylinder arrangement 1 includes a first cylinder 2 and first piston means 3, 4 for performing the conveying work. The second piston cylinder arrangement 21 for performing the power transmission and control comprises a second cylinder 22 and a second piston 24. The piston 4 and the piston 24 are interconnected by a piston tube 3 extending through an end wall 48 separating the first cylinder 2 from the second cylinder 22. A piston rod 23 extends coaxially through the piston tube 3 and rigidly interconnects the two pistons 4 and 24. An extension 23' of the piston rod 23 extends through the second cylinder 22 and out of the end wall 25 of the second cylinder 22.

A housing 51 is secured to the free end of the cylinder 2 adjacent to the outer piston surface 52 to form a work chamber 6. A further housing 53 is secured to the side of the cylinder 2 to surround an opening in the side wall of the cylinder 2 and to form a second work chamber 10, which communicates through said opening in the side wall of the cylinder 2 with the ring shaped rear surface 50 of the cylinder 4. The chamber 6 contains a pressure medium 8. The chamber 10 contains a pressure medium 7. The pressure medium may in both instances be oil or the like. A housing member 54 secured to the housing 51 forms a first conveying chamber 9 which is separated in a sealed manner from the work chamber 6 by a flexible wall 12, which may, for example, be made of strong rubber or the like. Similarly, a housing member 55 is secured to the housing 53 thus forming a further conveying chamber 11 which is separated from the work chamber 10 by a flexible wall 13 also made of rubber or the like to seal off the pressure medium from the viscous material to be conveyed. The chamber 9 forms a flow passage 14 and the chamber 11 forms a flow passage 15. A conduit 17 connects the flow passages 14 and 15 in series with each other. An inlet conduit 16 is connected to the housing members 51 and 54 at one end thereof and the conduit 17 is connected to said housings 51, 54 at the opposite end thereof. An outlet conduit 18 is connected to the housing members 53 and 55 at the oulet end thereof whereas the opposite end is connected to said series connecting conduit 17. The flexible walls 12 and 13 act as membranes or diaphragms.

A one way valve 19 is arranged at the inlet end of the passage 14 to close the inlet conduit 16. A further one way valve 17 is arranged adjacent to the upstream end of the conduit 17 to close the outlet of the passage 14. In order to maintain a continuous flow through the outlet conduit 18, it is preferable to keep the size of the ring shaped cross sectional surface 50 of the piston 4 equal to one half the inner sectional surface of the cylinder 2. In other words, the surface area of the ring surface 50 of the piston 4 will be about one half of the surface area of the outwardly facing surface 52 of the piston 4.

The operation of the present piston pump will now be described referring first to a forward stroke as indicated by the arrow 56.

Pressure medium is applied through the conduit 30 and the valve 32 from a source not shown for simplicity's sake. Both pistons 4 and 24 will move to the left whereby the pressure is increased in the chamber 10. As a result any viscous material present in the chamber 11 will be forced out through the outlet conduit 18, because the valve 20 closes in response to a pressure increase in the chamber 11 through the flexible diaphragm 13. Simultaneously, pressure is reduced in the chamber 6 and the valve 19 is opened, thereby admitting viscous material into the chamber 9 as a result of the suction effect caused by the pressure reduction in the chamber 6. With the valve 19 open, viscous material flows from a supply not shown through the conduit 16 into the chamber 9.

On the return stroke when the working pressure medium is admitted through the valve 31, the pistons 4 and 24 move in unison to the right as shown in FIG. 1, whereby the non-return valve 19 closes and the non-return valve 20 opens. Thus, a volume of viscous material in the chamber 9 is pressed through the conduit 17 into the chamber 11, said volume corresponding to the change in the size of the work chamber 6 as the pistons move back and forth. Since the volume of the work chamber 6 and of the work chamber 10 have a ratio to each other of 2:1, the return stroke, piston moves to the right, transports one half of the viscous material in the conduit 17 into the chamber 11, the size of which increases during this return stroke. The other half is moved out of the chamber 11 through the passage 15 into the outlet conduit 18. Thus, although the two passages 14 and 15 are connected in series and only the passage 15 is connected to the single outlet conduit 18, a conveying effect is achieved in the work chamber 7 on the forward stroke, when the piston moves to the left. This type of operation results in a continuous flow of the material to be conveyed although the entire structure of the piston pump is extremely simple.

The second piston cylinder arrangement 21 drives the first piston cylinder arrangement 1 of the pump. As mentioned, the cylinder 22 and the cylinder 2 have a common axis and are interconnected so as to be separated by the end wall 48. The piston tube 3 forms a hollow piston rod for the pump piston 4 and the guide rod 23 extends centrally and axially through the piston 4 as well as through the piston 24 of the cylinder 22. The rod extension 23' passes through a central bore in the end wall or cylinder cover 25. The connecting rod 26 couples the extension 23' to a control rod 27 in a rigid manner, whereby the control rod 27 follows the back and forth movement of the two pistons in synchronism therewith.

A compressed gas, preferably pressurized air, is used to drive the piston in the cylinder 22. The pressurized drive medium is admitted through a pressure conduit having two branches 29 and 30 connected to respective ends of the cylinder 22 through control valves 31 and 32 respectively. Upstream of the two branches there is arranged a pressure reduction valve 28 which may be controlled to select the opening passage for the pressurized medium. The valves 31 and 32 are two way valves. Downstream of the pressure reduction valve 28, but upstream of the branch conduits 29, 30 there is arranged a closure means 47 for regulating the flow quantity of the gas, the pressure of which is regulated by the valve 28. A flip-flop mechanism 57 merely shown in block form in FIG. 1 is operated by the control rod 27 as will now be described in more detail with reference to FIG. 2.

Figure 2:
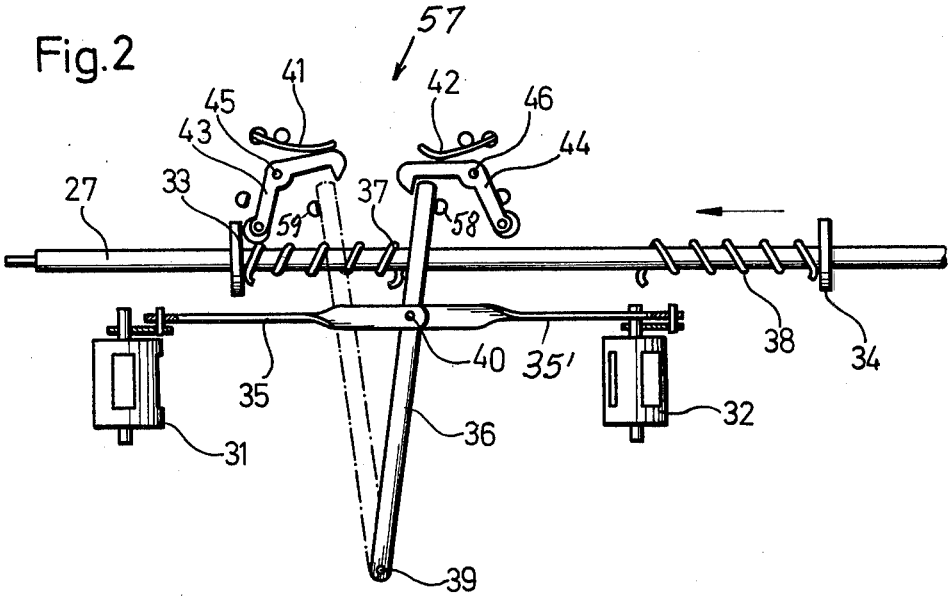
FIG. 2 illustrates one embodiment of a flip-flop reversing control mechanism.

FIG. 2 corresponds to the extreme right position of the pistons 4, 24, as shown in FIG. 1. At this instant the valve 31 is opened to release pressure medium from the cylinder 22 at the left end thereof and the valve 32 connects the pressure branch conduit 30 to the right hand end of the cylinder 22, thereby forcing the piston 24 in the direction of the arrow 56. The valves 31 and 32 are actuated by the flip-flop mechanism 57 which includes the control rod 27 having secured thereto two stop disks 33 and 34. Force transmitting lever means 35, 36 and 35' connect the valves to the flip-flop mechanism.

The control rod 27 extends through two coil springs 37 and 38 arranged between the stop member 33, 34. One end of the spring 37 rests against the stop 33. One end of the spring 38 rests against the stop 34. One end of the lever 36 is pivoted at 39 to a fixed point of a housing or the like not shown. The connecting levers 35 and 35' are pivoted to a pivot point 40 between the ends of the lever 36. The free end of the lever 36 extends upwardly for movement between two stops 58, 59. The left position of the lever 36 is shown in dashed dotted lines. The upper end of the lever 36 cooperates with two bell crank levers 43, 44 which are journaled to journal shafts 45, 46 respectively. Leak spring 41 tends to keep the bell crank 43 in a lever engaging position. Leaf spring 42 tends to keep bell crank 44 in a lever engaging position.

In operation, pressurized gas, for example, air is supplied through the pressure reduction valve 28 and passes through the closure or volume control valve 47 by means of which the flow volume may be controlled. Thus, it is possible to control the flow volume substantially continuously from a fully open passage down to a complete closure of the valve 47 at which point the pump would stop. The different opening positions of the closure valve 47 may be shown on a scale not illustrated for simplicity's sake, whereby the operator is enabled to control the flow quantity. Such valves 47 are well known in the art.

If the piston 24 approaches one or the other end position of its strokes, the corresponding springs 37 or 38 will be compressed, whereby the respective valves 31 or 32 are instantaneously switched over into the respective opposite position through the linkage levers 35, 35' and 36, whereby the respective ports in the cylinder 22 change their function. In other words, the inlet port becomes an outlet port and vice versa. To this end one of the stop members 33, 34 engages the respective bell crank 43, 44 to lift it against the force of the respective spring 41, 42, whereby the opposite end of the bell crank releases the upper end of the lever 36. As a result, the cocked spring 37 or 38 throws the lever 36 and thus the linkage lever 35, 35' into the respective opposite end position, whereby the valves 31, 32 are flipped over and the motion of the piston 24 is reversed.

Figure 3:
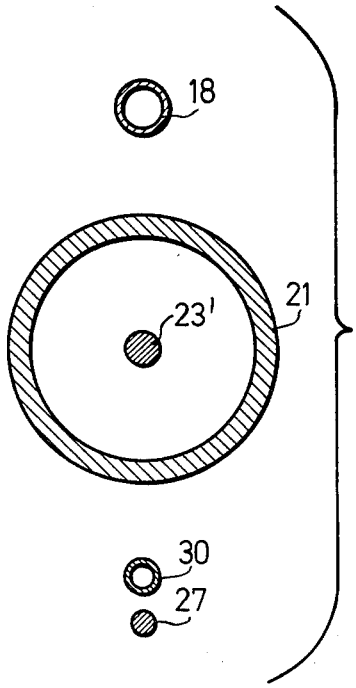
FIG. 3 is a sectional view along section line III—III in FIG. 1.

FIG. 3 illustrates the position of the structural elements relative to each other. The guide rod 23 and its extension 23' are located coaxially in the two cylinders 2 and 22. Movement of the pistons and thus of the guide rods 23, 23' is transmitted to the control rod 27. Preferably, the central axis of the outlet conduit 18 and of the pressure supply conduit 30 as well as of the control rod 27 and the common axis of the two cylinders are all located in the same plane, as shown in FIG. 3.

A tool, such as a spray gun, or the like not shown, may be connected to the outlet conduit 18.

In view of the foregoing, it will be appreciated that the piston 24 is always subject to the pressure medium on one or the other of its faces. The flip-flop device 57 is actuated by the piston rod extension 23' in each of the end positions of the piston 24 to assure the piston reversal. When the valve 32 admits pressure medium, the valve 31 will release pressure medium and vice versa.

According to a preferred embodiment of the invention, the structure is such, that the piston displacement of the piston 4 provides for different volumes in the work chambers 6 and 10 and thus in the conveying chambers 9 and 11, whereby the volume ratio is preferably 1:2, so that a continuous, uninterrupted conveying or feeding is assured. This feature makes the pump according to the invention especially suitable in the construction industry, for example, for conveying mortar or the like, especially since the light structure of the pump makes it possible to use it in almost any location, for example, on a scaffold, and no special foundation is necessary for the pump.

The arrangement of the pressure reduction valve 28 and the volume control valve 47 in the sequence shown in FIG. 1 relative to the pressure medium flow has the advantage that the feeding speed and the feeding quantity are easily controlled.

Although the invention has been described with reference to specific example embodiments, it is to be understood, that it is intended to cover all modifications and equivalents within the scope of the appended claims.

What is claimed is:

1. A continuously operable piston pump for conveying viscous materials comprising first and second conveying chambers, each of said chambers having at least one flexible wall means partly defining the respective chamber, conduit means operatively connecting the first and second conveying chambers in series, differentially operable cylinder piston means with a fluid therein for operating said flexible wall means which sealingly separate the fluid from the viscous material, inlet and outlet conduit means communicating respectively with said first and second conveying chambers, nonreturn valve means disposed at said inlet conduit means, and at said first mentioned conduit means, and means arranged for controlling said differentially operable means, said control means including flip-flop means for reversing said cylinder piston means, said control means further comprising control cylinder piston means, a common axis on which said differentially operable cylinder piston means and said control cylinder piston means are arranged, common piston rod means extending along said common axis and out of said control cylinder piston means, and means connecting said flip-flop means to said common piston rod means.

2. The pump according to claim 1, wherein said differentially operable cylinder piston means comprises a first piston and a piston tube, said control means comprising a second piston and a guide bar concentrically disposed within said piston tube, said guide bar coupling the first and second pistons to each other, said differentially operable cylinder piston means further comprising a first cylinder, said control means further comprising a second cylinder, said first and second cylinders being arranged on a common axis, and wall means separating said first and second cylinders, said piston tube extending through said wall means.

3. The pump according to claim 2, wherein said first piston has a front surface and a ring rear surface, said second piston also having a front surface and a ring rear surface, each front surface having a surface area about twice as large as the respective rear surface.

4. The pump according to claim 3, wherein the front surfaces are substantially equal to each other in surface area, and wherein the rear surfaces are also substantially equal to each other in surface area.

5. The pump according to claim 2, wherein said control means comprising said second piston and said second cylinder, further comprise control valve means operatively arranged at each end of said second cylinder, pressure conduit means connected to said second cylinder through said control valve means for subjecting one or the other side of said second piston to a pressure medium, and means operatively connecting said flip-flop means to said valve means whereby pressure medium is admitted into the second cylinder at one end thereof and exhaused at the other end thereof and vice versa.

6. The pump according to claim 5, further comprising pressure reduction valve means disposed within said pressure conduit means upstream of said control valve means.

7. The pump according to claim 5, further comprising closure valve means located in said pressure conduit means between said pressure reduction valve means and said control valve means.

* * * * *